United States Patent [19]

Peterson

[11] 3,989,002

[45] Nov. 2, 1976

[54] MOTOR POWERED WATERCRAFT FOR RIDING IN STANDING POSITION

[75] Inventor: Philip C. Peterson, Northbrook, Ill.

[73] Assignee: Philip C. Peterson, Northbrook, Ill.

[22] Filed: Nov. 20, 1975

[21] Appl. No.: 633,802

[52] U.S. Cl. ..... 115/70

[51] Int. Cl.[2] ..... A63H 5/08

[58] Field of Search ..... 115/17, 18 R, 70, .5 R; 9/6 P; 180/5 R, 6 A; 74/473 R, 480 B, 488, 489, 491, 551.1

[56] References Cited

UNITED STATES PATENTS

| | | | |
|---|---|---|---|
| 2,788,676 | 4/1957 | Spexarth | 74/489 |
| 3,481,303 | 12/1969 | Tate et al. | 115/70 |
| 3,584,590 | 6/1971 | Rings et al. | 115/70 |
| 3,790,977 | 2/1974 | Bombardier et al. | 115/70 |
| 3,812,814 | 5/1974 | Veilleux | 115/70 |
| 3,827,391 | 8/1974 | Stanberry et al. | 115/70 |
| 3,856,123 | 12/1974 | Kinsey | 74/489 |

*Primary Examiner*—Trygve M. Blix
*Assistant Examiner*—Jesus D. Sotelo
*Attorney, Agent, or Firm*—Mason, Kolehmainen, Rathburn & Wyss

[57] ABSTRACT

A boat adapted to be powered by an outboard motor pivotally mounted on the transom, the motor of the type including a throttle and a gear shift. The boat includes a hull having a bottom wall, a bow and a stern and a floor adapted for supporting a rider in standing position intermediate the bow and stern. An upstanding rider support structure adjacent a forward portion of the floor extends upwardly to a level above the floor for providing physical support for a rider in standing position while riding the boat. A unitary control for the boat and outboard motor includes a handle bar structure pivotally mounted on the rider support structure and cable-connected for steering the outboard motor by pivoting the motor on the transom. A rotatable motor throttle control is mounted adjacent a portion on one side of the handle bar for axial rotation and is cable-interconnected for controlling the throttle position of the outboard motor. A rotatable gear shift control is mounted on an opposite portion of the handle bar and is cable-interconnected for controlling the gear shift of the outboard motor.

26 Claims, 8 Drawing Figures

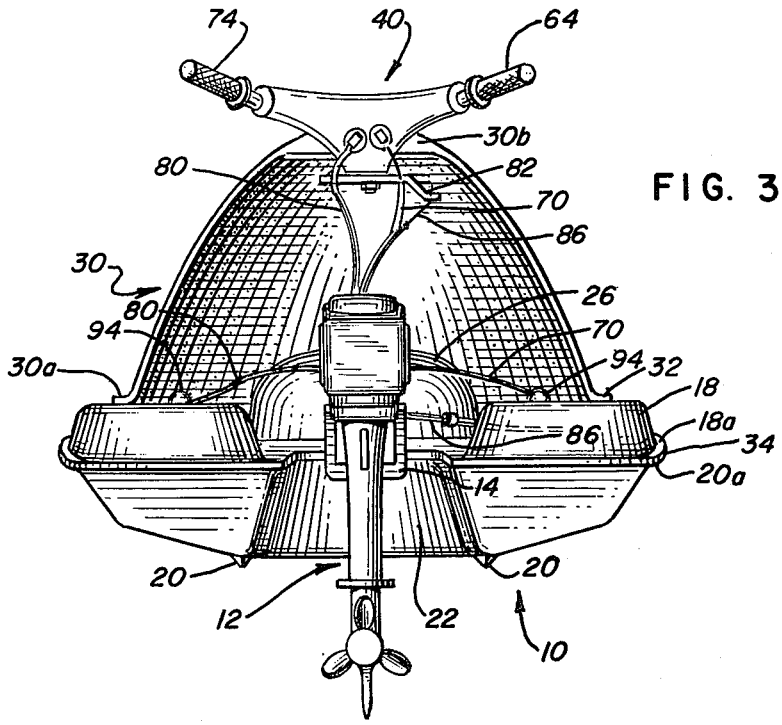
FIG. 3
FIG. 4
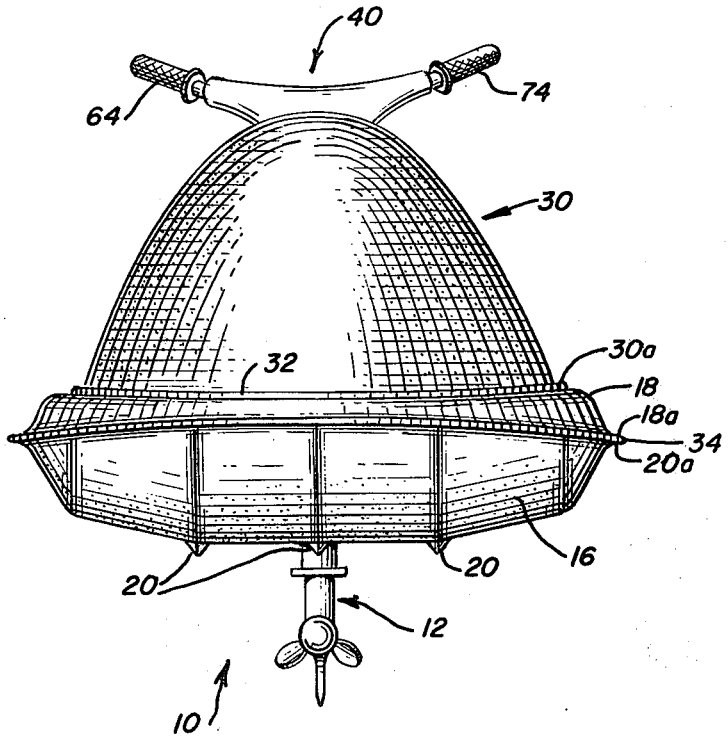

FIG. 6
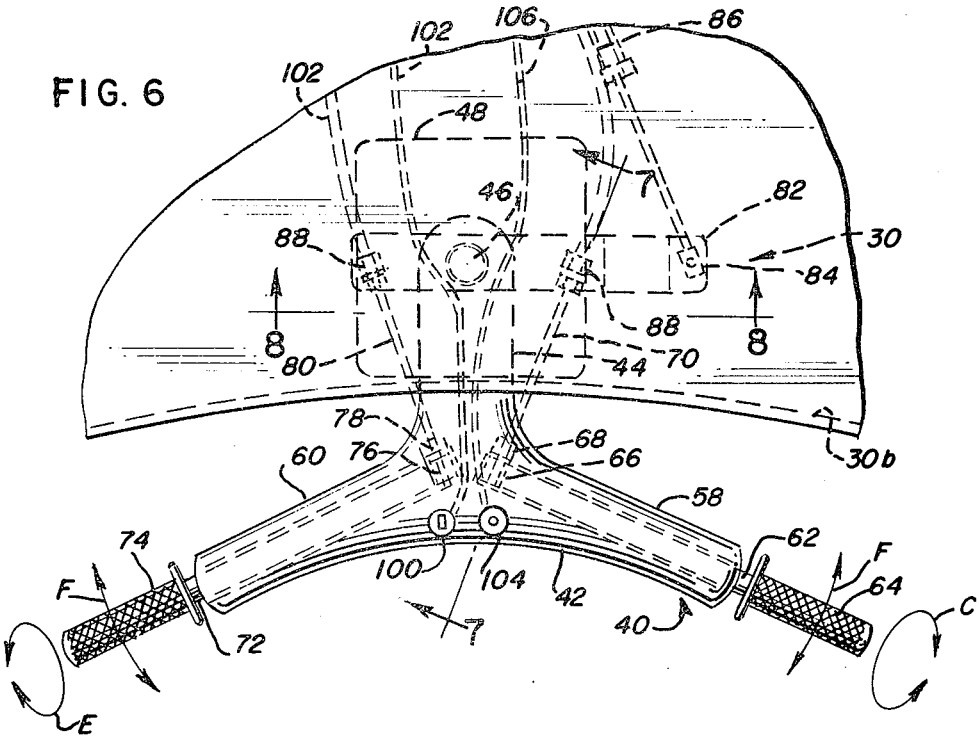
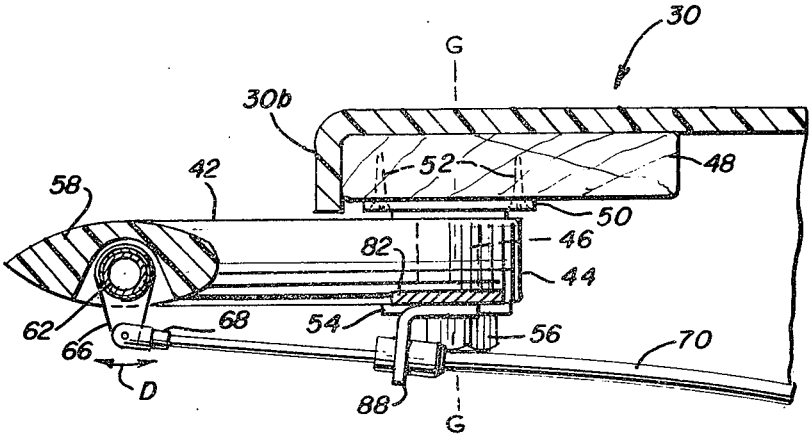
FIG. 7
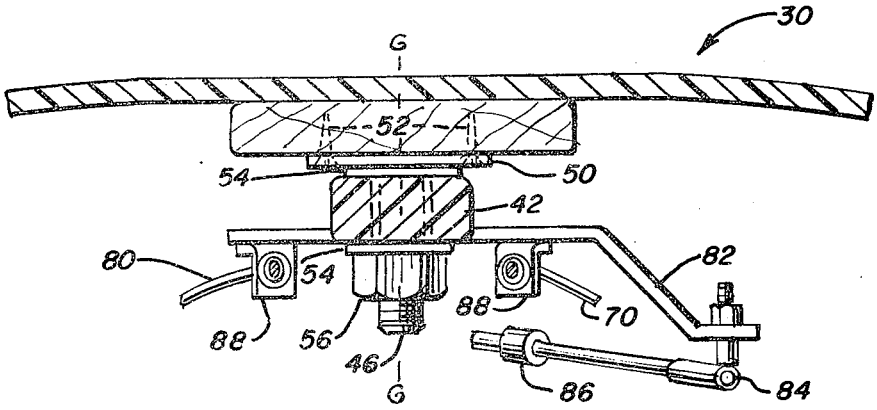
FIG. 8

MOTOR POWERED WATERCRAFT FOR RIDING IN STANDING POSITION

BACKGROUND OF THE INVENTION

1. Field of the Invention

The present invention relates to a new and improved boat or watercraft adapted to be powered by a conventional outboard motor and particularly, a boat designed fro control by a rider in standing or upright position on the boat. More particularly, the present invention relates to a relative small boat, suitable for one or two riders, which boat is fast, light in weight, highly maneuverable, and easily controlled by the rider in standing position on the boat.

It is an object of the present invention to provide a new and improved boat or watercraft of the character described.

More particularly, it is an object of the present invention to provide a boat which is especially adapted for use by a rider(s) in standing or upright position.

Another object of the present invention is to provide a new and improved boat of the character described which is especially adapted to be powered by a conventional outboard motor pivotally mounted on the transom.

Still another object of the present invention is to provide a new and improved boat or watercraft of the character described having a unitary control means for the outboard motor comprising a handle bar for steering the motor with throttle and shift control means on opposite ends of the handle bar for controlling the throttle position and the gear shift of the outboard motor.

Yet another object of the present invention is to provide a new and improved boat or watercraft of the character described including a novel support system for a rider in standing position on the boat including motor control means for the outboard motor.

Yet another object of the present invention is to provide a new and improved boat of the character described which is relatively low in cost, light in weight, highly maneuverable, simple in construction and natural and easy to operate and control.

Still another object of the present invention is to provide a new and improved outboard powered boat which is easily and naturally controlled by a passenger in standing position on the boat forward of the outboard motor.

2. Description of the Prior Art

Many attempts have been made in the prior art to provide a stand-up type watercraft which is safe, fast and highly maneuverable. However, many of these prior art devices have not been commercially successful because of extremely complex mechanisms requiring high cost and difficulty or servicing, particularly for a small boat capable of only carrying one or two persons.

One prior art boat is referred to as a jet powered aquaplane and is shown and described in the June 1964 issue of Popular Science Monthly Magazine. Another prior art boat is marketed by the Kawasaki Company of Japan and is sold under the trademark "JET-SKI". Both of these prior art boats employ an engine powered water pump or jet rather than a conventional outboard motor.

Another prior art device is manufactured by The Power Ski Corporation of Chicago, Illinois and employs a modified outboard type power plant.

Yet another prior art boat is manufactured and sold under the name "Dynafoil" by the Dynafoil Inc. of Newport Beach, Calf. This latter boat utilizes a hydrofoil and has a relatively complex power mechanism for driving the vehicle. None of these prior art boats use a readily available conventional or standard outboard motor with conventional or standard control cables.

SUMMARY OF THE INVENTION

The foregoing and other objects and advantages of the present invention are accomplished in an illustrated embodiment herein comprising a small, stand-up type boat or watercraft adapted to be powered by a conventional outboard motor pivotally mounted on the transom for powering and steering the boat. A conventional or standard outboard motor normally includes a throttle and a gear shift lever engineered for operation from a remote location by means of push-pull control cables. The boat comprises a hull having a bottom wall, a bow and a stern and floor means is provided on the hull for supporting a person in a standing position intermediate the bow and stern. An upright support structure is provided adjacent a forward end portion of the floor means to extend upwardly from the hull to a level conveniently above the floor to provide a base structure for supporting a novel control system for the outboard motor which is grasped by the standing rider. The control system includes a handle bar pivotally mounted on the support structure and interconnected via a cable for steering or pivoting the outboard motor on the transom. A rotatable motor control is mounted adjacent on outer end portion on one side of the handle bar for axial rotation while gripped by one hand of the rider and a throttle control cable is interconnected between the handle bar and the throttle lever of the outboard motor. Similarly, a rotatable gear shift control is mounted adjacent the outer end on the opposite side of the handle bar and is cable interconnected for controlling the gear shift lever of the outboard motor. A person riding the boat in standing position on the floor grips both controls on the handle bar for physical support in a standing position while continuously controlling the operation of the outboard motor.

BRIEF DESCRIPTION OF THE DRAWINGS

For better understanding of the invention, reference should be had to the following detailed description taken in conjunction with the drawings, in which:

FIG. 3 is a rear elevational view of the boat;

FIG. 4 is a front elevational view of the boat;

FIG. 6 is an enlarged fragmentary sectional view looking in the direction of the arrows 6—6 of FIG. 1 and illustrating the novel control system of the boat;

FIG. 7 is a sectional view taken substantially along lines 7—7 of FIG. 6; and FIG. 8 is a sectional view taken substantially along lines 8—8 of FIG. 6.

DESCRIPTION OF THE PREFERRED EMBODIMENT

Figure 5:
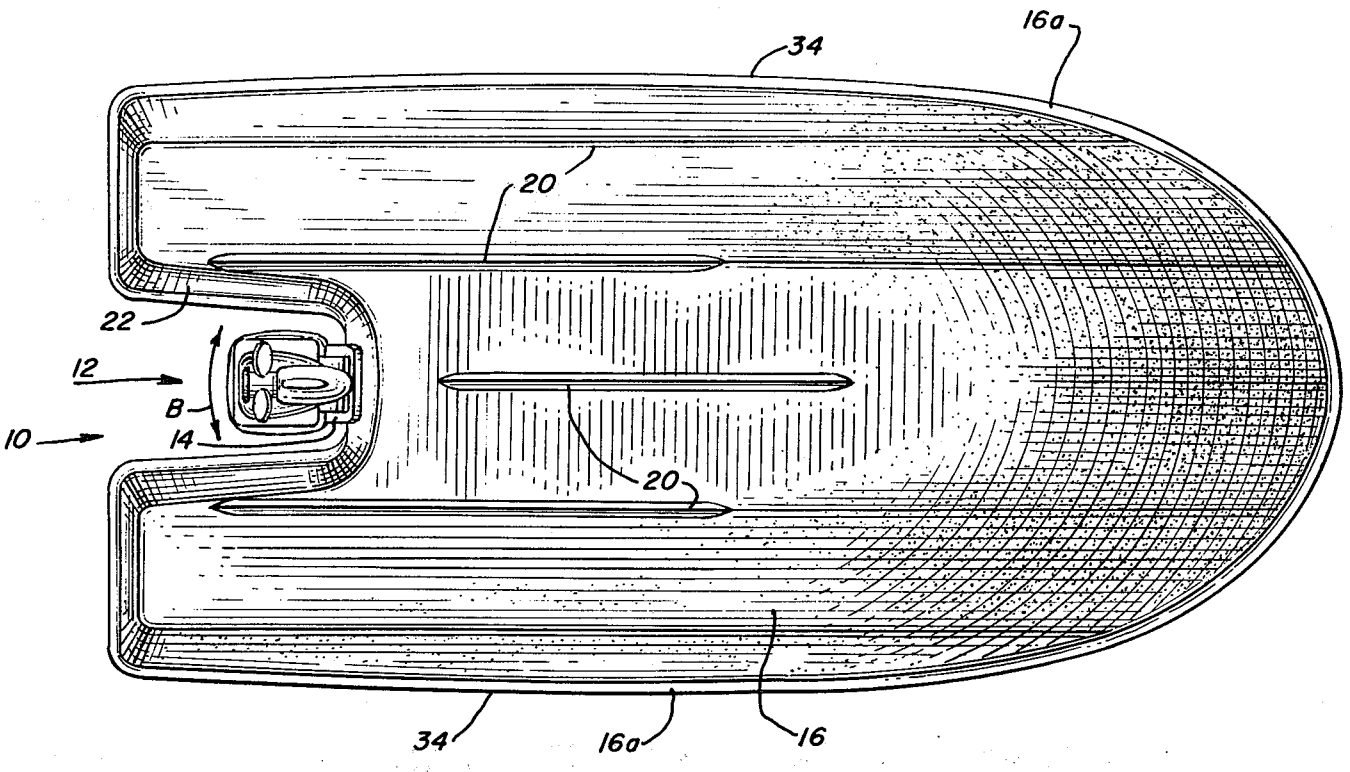
FIG. 5 is a bottom plan view of the boat.

Referring now more particularly to the drawings, therein is illustrated a new and improved boat or watercraft constructed in accordance with the features of the present invention and generally referred to by the reference numeral 10. The boat 10 is designed for one or more riders in an upright or standing position and is especially designed and constructed to be powered by a conventional or standard outboard motor 12 pivotally mounted on a transom or motor board 14 in a conventional manner. The transom or motor board 14 is positioned forward of the rearward or stern end of the boat. The boat includes a hull structure formed by a bottom 16 of molded, fiberglass, reinforced, polyester or epoxy resin. The hull bottom 16 includes a joint flange 16*a* around the upper periphery secured to a lower joint flange 18*a* of a top or deck structure 18 also preferably formed of molded, fiberglass, reinforced, polyester or epoxy resin. The hull bottom 16 is of the planing type with a modified Vee configuration adjacent the forward end portion and is formed with a plurality of elongated strakes or fins 20 which aid in preventing slipping or skidding in turns and add stiffness and strength to the hull structure. As shown best in FIGS. 2, 3 and 5, because the transom or motor board 14 is forward of the aft or rear end of the hull, the weight of the outboard motor 12 is shifted forwardly on the boat and a motor well 22 is provided. The motor well or opening is sufficiently wide to permit full pivotal steerage movement of the motor on the transom as represented by the arrows A and B in FIGS. 2 and 5, and because the motor is forward of the aft end of the boat, the possibility of contact with the propeller by a person in the water is minimized.

Figures 1, 2:
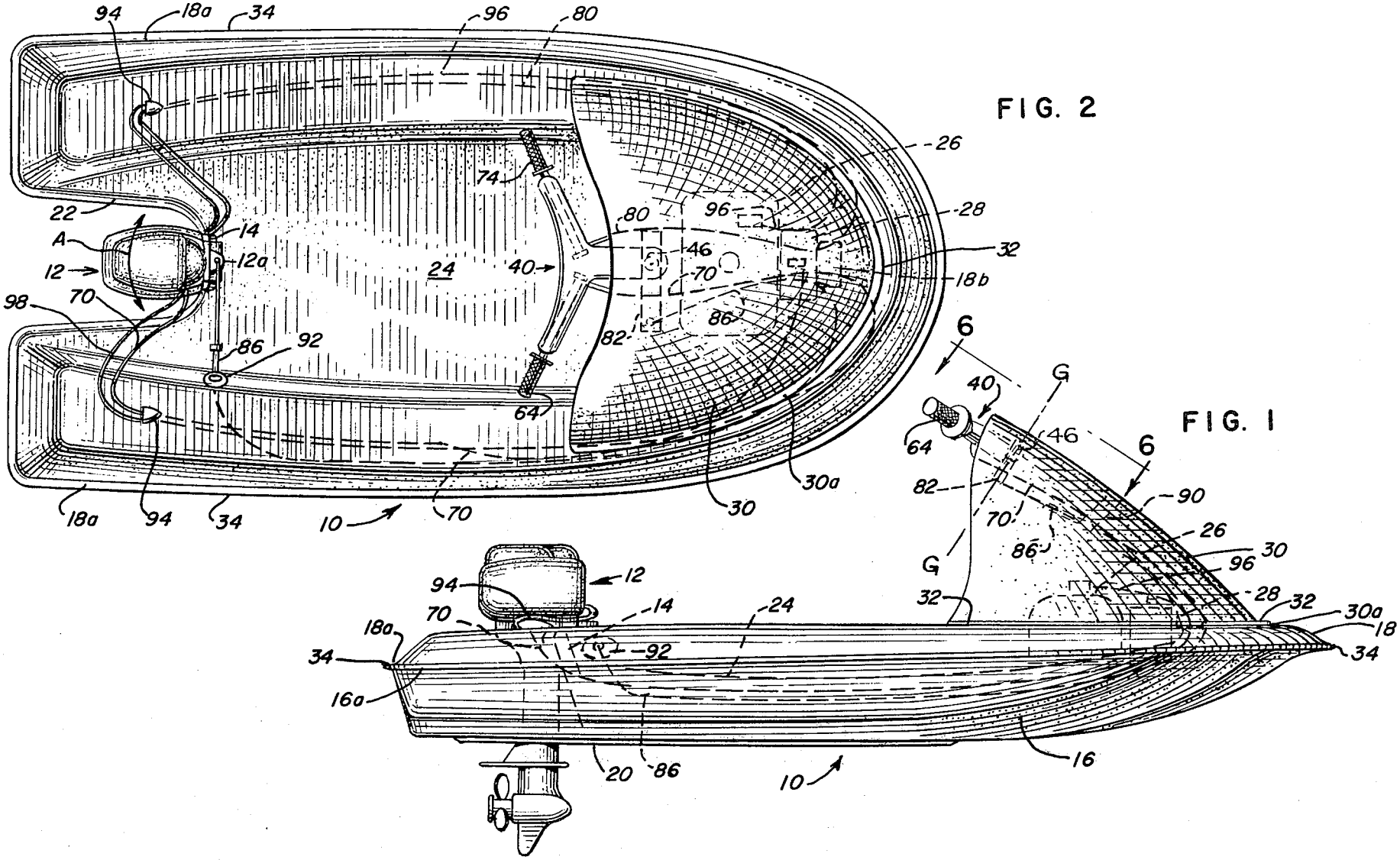
FIG. 1 is a side elevational view of a new and improved boat constructed in accordance with the features of the present invention.
FIG. 2 is a top plan view of the boat.

Referring to FIGS. 1 and 4, it will be seen that although the hull 16 is of the planning type, the forward end portion is of a modified V-type profile to better slice or cut through wave action or swells. Steerage of the boat is accomplished by turning or pivoting the motor 12 on the transom 14 as indicated by the arrows A and B but underway the boat can be steered by shifting of the weight of the rider laterally to either side of the longitudinal axis of the boat. The transverse cross-section of the hull (as shown) in FIGS. 3 and 4) is designed to provide for steerage of the boat by shifting of the rider's weight and this action is natural to the rider as he simply leans into the direction of the turn he wants to make. The turn can be shallow or sharp as desired and the radius of the turn is controlled by the amount of leaning or weight shift. When the boat is moving at relatively fast rates, very little leaning or weight shift is required while at lower speeds, more weight shift or leaning into the turn is needed.

In accordance with the present invention, the top or deck structure 18 of the hull is formed with a central floor section 24 which extends forwardly of the motor 12 and transom 14. The floor 24 is relatively flat and is suitably reinforced to support one or more riders standing thereon. The relatively flat floor section may slope upwardly at a slight angle when the boat is moving so that any water falling onto the floor will drain off the rear end of the boat. Preferably, the floor is provided with a non-skid surface of some type so that a rider in bare feet will not slip easily. Adjacent the forward end, the floor section provides support for a remote fuel tank 26 and a battery in a box 28, if the outboard motor 12 is of the electric starting type. In order to aid in supporting the riders on the boat while in a standing position on the floor section 24, an upwardly extending hood or shroud structure 30 is mounted adjacent the forward end portion of the boat on the top or deck structure 18. The hood includes a lower peripheral flange 30*a* attached to the deck by pop rivets or other suitable fasteners. The peripheral joining flanges 16a and 18a of the hull 16 and top structure 18 are similarly secured together with pop rivets or other fasteners. Preferably, the flange 30*a* of the hood 30 is covered with a trim molding 32 and the joint between the flanges 16*a* and 18*a* is covered by a rub rail type joint molding 34 to provide a pleasing appearance and protect the boat from dock or mooring damage.

The hood 30 provides an enclosure for the fuel tank 26 and battery box 28 and in addition, forms an air deflector which reduces air resistance and helps to prevent waves or spray from spilling onto the forward portion of the floor section 24. In addition, the hood provides a supporting structure for a unitary control mechanism 40 for the remote control and steerage of the outboard motor 12.

The unitary control 40 includes a handle bar-like body 42 of generally Y-shaped configuration and may be formed of metal such as stainless steel, aluminum or plastic material of suitable strength as shown. Referring to FIGS. 6, 7 and 8, the body 42 includes a central leg 44 pivotally secured on an axle pin or bolt 46 which extends downwardly from a mounting or stiffening block 48 of plywood or the like (as best shown in FIGS. 7 and 8). The plywood block 48 is secured to the underside of the molded fiberglass hood 30 adjacent the rearward or open end at the center and the hood is formed with a down turned flange 30*b* at the open rearwardly facing end to provide additional stiffness for the hood structure. The pivot axle 46 may comprise a stainless steel bolt having a mounting plate 50 attached to the upper end and secured to the underside of the mounting block 48 by screw fasteners 52. A pair of washers 54 are interposed against the upper and lower surfaces of the center leg 44 of the Y-shaped control unit body 42 and a lock nut 56 is provided on the threaded lower end of the bolt to secure the control unit 40 in place on the hood. As viewed in FIG. 6, the Y-shaped control body 42 includes a right hand leg or handle bar section 58 and a left hand handle bar section or leg 60 extending outwardly of the center leg at divergent angles as shown. The right hand leg 58 provides support for a tubular axle 62 having a throttle control hand grip 64 on the outer end portion. At the inner end the axle 62 is provided with a lever arm 66 having an outer end pivotally interconnected with a clevis 68 on the control end of a conventional or standard throttle control cable 70 of the push-pull type as manufactured by Teleflex Marine, Morse Controls or N.W. Controls for outboard motors. When the throttle control hand grip 64 is axially rotated as shown by the arrow C in FIG. 6, the inner end of the hollow shaft 62 is rotated and the lever 66 pivots as shown by the arrow D in FIG. 7 to push or pull the central control wire of the throttle cable 70 and thereby control the throttle lever on the outboard motor 12 to which the cable is connected.

The left hand leg 60 of the Y-shaped control body 42 provides support for another hollow axle 72 having a shift control hand grip 74 on the outer end. At the inner end, the shift axle 72 is provided with a lever 76 pivotally attached to a clevis 78 mounted on the end of the central push-pull wire of a gear shift control cable 80 of a type similar to the throttle control cable 70. Axial rotation of the shift control hand grip 74 as indicated by the arrow E in FIG. 6 is operable to move the push-pull wire of the shift cable 80 which is connected to the shift control lever on the outboard motor 12 and this controls the motor gears to shift between neutral, forward and reverse depending upon the direction that the rider on the boat wishes to travel. From the foregoing it will be seen that the unitary control 40 provides both physical support for the rider while in a standing position on the boat floor section 24 because of the convenient handles which are gripped by both hands and in addition, provides for remote shift and throttle control of the outboard motor 12. The rider need not release his grip on either of the hand grips 64 or 74 to effect the desired engine control and can at all times underway maintain a firm and positive physical grip on the handle bar structure with both hands. The handle bar type of precise and positive remote control of the outboard engine 12 and its throttle and shift levers afforded by the control unit 40 are alone new and unique. In addition, the control 40 is adapted to control the pivoting or steerage movement of the outboard motor on the transom or motor board 14. For this purpose, the control includes a steering lever arm 82 extending transversely of the center leg 44 of the Y-shaped body 42 adjacent its inner or pivotally supported end. As viewed in FIG. 6, on the right hand outer end portion of the lever arm 82 there is provided a ball joint connector 84 attached to the central push-pull cable of a jacketed steering cable 86. The steering cable 86 is of the conventional push-pull type manufactured by the aforementioned control cable manufacturers and includes telescopic fittings on both the control and motor ends of the cable to provide the required cable travel to effect full limit steerage of the outboard motor on the transom.

The outer jacket of the throttle cable 70 and the shift cable 80 are removably secured to the steering arm 82 by means of angle brackets 88 (FIGS. 7 and 8) so that rotation of the throttle and gear shift hand grips 64 and 74 provides the required relative translation between the central push-pull wires and the respective outer jackets of the cable to effect the desired control action at the motor end of the cables connected to the outboard motor throttle and shift levers. The outer jacket of the steering cable 86 is secured to the underside of the hood or shroud 30 by means of a bracket 90 having a ball joint connection so that when the Y-shaped body 42 of the unitary control is pivoted on the axle 46 as indicated by the arrows F in FIG. 6, the central push-pull cable of the steering cable 86 is translated relative to the outer jacket to provide the telescopic action at the engine end and the motor. As shown in FIGS. 1 and 2, the motor end of the central core of the cable 86 is pivotally interconnected to a steering bracket 12*a* on the outboard engine and the jacket of the cable passes through and is secured to a conventional, swiveling splash well mounting fitting 92 mounted on an adjacent upstanding wall portion of the deck structure 18. The steering cable bracket 90 and the splash well fitting 92 permit angular movement of the cable 86 as the push-pull cable is moved relative to the outer cable jacket and these fittings are conveniently available from the Teleflex Marine or the Morse Cable firms. The throttle cable, shift cable and steering cables run beneath the underside of the hood 30 and pass downwardly through an opening 18*b* (FIG. 2) in the deck structure 18 adjacent the forward end portion of the shroud 30. These cables then pass rearwardly on the boat in the enclosed space between the hull bottom 16 and the deck structure 18. The throttle and shift cables pass out through the deck structure at the rear end of the boat via suitable through-hull fittings 94 mounted on opposite sides of the outboard motor 12.

Fuel for the outboard motor 12 is supplied from the remote fuel tank 26 via a fuel line 96 which is connected to the fuel tank and also passes through the opening 18*b* in the deck 18 and then rearwardly in the boat hull. The fuel line also passes through one of the through-hull fittings 94 and is connected to the outboard motor with the usual fuel connector fitting. If the outboard motor 12 is of the electric starting type, an electrical cable harness 98 is interconnected between the outboard motor 12 and passes through one of the through-hull fittings 94 and up through the access opening 18b in the deck for connection with the battery in the battery box 28. As illustrated in FIG. 6, with an electric starting engine, an ignition and starter switch 100 may be mounted on the central portion of the Y-shaped control unit body 42 and an electrical cable 102 (dotted lines, FIG. 6) is interconnected between the ignition switch and the battery and the electrical cable harness 98 running to the outboard engine.

As an additional safety feature, the boat 10 is provided with a kill switch 104 which is also preferably mounted on the central portion of the Y-shaped control unit body 42. The kill switch 104 is electrically interconnected via a grounding cable 106 and the electrical cable harness 98 to ground the magnetos of the outboard engine 12 when the kill switch is activated by a rider unintentionally becoming dislodged from the boat. The rider attachhes a kill switch lanyard to his arm or body and when he falls from the boat, the lanyard pull removes a cap or plug on the kill switch allowing the contacts thereof to close. When the contacts close, the outboard engine 12 is immediately stopped as the primary windings of the magneto are grounded out. The kill switch 104 may be of the type manufactured and sold by N. W. Controls Inc. which are used on snowmobiles as well as boats for the same purpose, and the switch is wired in a known manner to provide the described safety feature.

The boat 10 is provided with foam floatation material between the hull bottom 16 and top deck 18 to meet safety standards of the U.S. Coast Guard and the Boating Industry Assocation. Preferably, much of the floatation material is located just below the upper deck structure 18 so that the boat has little or no tendency to turn upside down should it become swamped or spring a leak in the hull or deck structure. The boat is also constructed to meet horsepower and weight limit standards of the U.S. Coast Guard as promulgated under the Federal Boating Safety Act and as set forth in the standards of the Boating Industry Association.

From the foregoing it will be seen that the unitary control system 40 provides both physical support for a rider in standing position on the floor section 24 of the boat and in addition, provides motor steerage control, throttle control and shift control. The control unit provides a convenient location for an electrical starting and ignition control switch and the kill switch of the safety system for shutting down the engine when a rider inadvertently becomes dislodged or falls from the boat while the engine is running. The boat 10 thus presents an entirely new concept in boating which is extremely pleasurable and yet is safe and relatively low in cost.

Because the control unit body 42 is pivoted on the axle 46 which lies on a central vertical plane of the boat sloping downwardly and rearwardly at a relatively steep angle as shown by the line G—G in FIG. 1, there is very little relative movement of the control unit relative to the longitudinal or roll axis of the boat when the control is used to produce a maximum rate turn. This arrangement provides lateral support for a standing rider in a roll direction as the turns are made because most of the turning action of the control unit 40 is in a push or pull direction longitudinally of the boat. Thus, in a right turn, the right hand is pushed forward and the left hand pulled rearward, but rolling of the control unit about a longitudinal axis relative to the boat hull is restricted so that the control unit body 42 provides good lateral support for the rider during turns. Snowmobiles have control units pivotable about a longitudinal axis (sometimes nearly horiztonal) and thus would not provide sufficient lateral or roll support for the rider in a turn as does the control unit 40. The pivot axis G—G of the control unit on the support axle 46 is set up to be in a range of about 40° to 65° from the level of the platform 24 and this angle range provides excellent steerability and support for a rider in standing position.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. In a watercraft adapted to be powered by an outboard motor pivotally mounted on a transom for steering said watercraft, said motor including a throttle, and a gear shift, the combination comprising:

a hull having a bottom wall, a bow and a stern;

floor means on said hull adapted for supporting a rider in standing position intermediate the bow and stern of said hull;

a rider support structure adjacent a forward end of said floor means extending upwardly to a level above said floor means for providing support for a rider in standing position on said floor means, and control means for said motor including handle bar means pivotally mounted on said support structure for limited pivotal movement in a plane sloping upwardly and rearwardly of the bow of said hull about an axis sloping upwardly and forwardly of said floor means and connected for steering said outboard motor, a rotatable motor throttle control mounted adjacent a portion on one side of said handle bar means for axial rotation thereon while grasped by the hand of a rider and interconnected to control the throttle position of said outboard motor, and a rotatable gear shift control mounted adjacent a portion on an opposite side of said handle bar means and interconnected to control said gear shift of said outboard motor.

2. The watercraft combination of claim 1 wherein said rider support structure includes a housing forming a wind-screen sloping upwardly and rearwardly from a forward position adjacent the bow of said hull and sloping upwardly and inwardly from adjacent opposite sides of said hull, said handle bar means pivotally supported from said housing for limited pivotal movement about an axis lying in a vertical plane longitudinally bisecting said hull extending between said bow and stern.

3. The watercraft combination of claim 2 wherein said housing is formed with an open end facing aft toward the stern of said hull.

4. The watercraft combination of claim 1 wherein said hull includes a top wall substantially enclosing said bottom wall, said floor means comprising an intermediate portion of said top wall.

5. The watercraft combination of claim 4 wherein said top wall includes a peripheral edge portion extending around a forward portion and said portions of said floor means and elevated above the level of said floor means.

6. The watercraft combination of claim 5 wherein said top wall includes a rearward portion sloping downwardly from a rearward end of said floor means.

7. The watercraft combination of claim 3 including a fuel tank for said outboard motor removably mounted in said housing adjacent a forward end of said floor means.

8. The watercraft combination of claim 7 including battery means removably mounted in said housing forward of said fuel tank.

9. The watercraft of claim 5 wherein said control means includes push-pull control cables for shifting gears and moving said throttle, said peripheral edge portion of said top wall having a forward opening for said control cable in communication between said hull and said housing and a rearward opening for said control cables adjacent said outboard motor.

10. The watercraft of claim 3 including a safety system for automatically shutting down said outboard motor, said system including safety switch means mounted on said housing and including a switch operator member adapted to be interconnected to a rider and removable from said switch means to operate the same when said rider unintentionally dismounts from said floor means.

11. A unitary control for a watercraft having steering, shift and throttle control cables comprising:

a control member adapted to be mounted for pivotal movement on said watercraft about a pivot axis in a plane longitudinally of said watercraft, said pivot axis sloping upwardly and forwardly intermediate a bow and stern of said watercraft, first connector means on said member eccentric of said pivot axis interconnectable with said steering control cable for effecting steering control upon pivotal movement of said member about said pivot axis, a first hand grip on one side of said pivot axis and a second hand grip on an opposite side of said pivot axis, both mounted for rotation on said control member about axes remote from said pivot axis, and a pair of cable connectors mounted on said control member and extending inwardly of said respective hand grips for interconnecting said first and second hand grips with said shift and throttle control cables respectively at connecting points adjacent said pivot axis on opposite sides thereof for effecting shift and throttle control upon rotation of said hand grips.

12. The control of claim 11 wherein said control member includes a body having a pair of elongated arms extending outwardly in generally opposite directions from a central portion containing said pivot axis, said hand grips supported from said arms for rotation about axes extending longitudinally thereof.

13. The control of claim 12 wherein said axes of rotation of said hand grips are on a common plane and said pivot axis of said control member extends through said plane at a point spaced from said axes of hand grip rotation.

14. The control of claim 13 wherein said axes of said hand grips intersect at an obtuse angle at said central portion at a point remote from said pivot axis.

15. The control of claim 12 wherein said pair of connectors includes a pair of axles extending outwardly of outer ends of said arms for supporting said hand grips on outer end portions of said axles, said axles supported for rotation on said arms and including inner end portions adjacent said central portion of said control member, and levers interconnecting said inner end portions and said throttle and shift control cables.

16. The control of claim 12 wherein said control member is of a Y-shaped configuration with said arms intersecting at an angle and including a leg forming said central portion and intersecting said arms, said pivot axis extending through said leg adjacent an outer end thereof.

17. In a watercraft adapted to be powered by an outboard motor having a pivotable transom mount for steering, a throttle, and a gear shift, the combination comprising:

a hull having a bottom wall, a bow and a stern;

platform means on said hull for supporting a rider in standing position intermediate the bow and stern of said hull;

transom means spaced intermediate of said bow and stern for supporting an outboard motor in pivotal driving position on said hull adjacent an aft end of said platform means;

rider support means adjacent a forward end of said platform means including a steering handle bar mounted at a level spaced above said platform means for limited pivotal movement in a plane sloping upwardly and rearwardly of a forward position on said hull about an axis sloping upwardly and forwardly of said floor means, said handle bar having portions on opposite sides of a longitudinal axis of said hull adapted to provide support for the hands of a rider in standing position, and control means interconnected with said handle bar for steering said outboard motor on pivotal movement of said handle bar, a motor throttle control coaxially mounted on one of said portions of said handle bar for relative rotation thereon while grasped by the hand of a rider and interconnected to control the throttle position of said outboard motor, and a gear shift control on the other of said portions of said handle bar and interconnected to control the gear shift of said outboard motor.

18. The watercraft combination of claim 17 wherein said rider support means includes a housing forming a wind-screen sloping upwardly and rearwardly from adjacent the bow of said hull and sloping upwardly and inwardly from adjacent opposite sides of said hull, said handle bar pivotally supported from said housing for limited pivotal movement about a pivot axis in a plane bisecting said hull longitudinally sloping upwardly and forwardly of a position intermediate said bow and stern.

19. The watercraft combination of claim 18 wherein said housing is formed with an open end facing aft toward the stern of said hull and includes an aft portion spaced above a forward portion of said platform means.

20. The watercraft combination of claim 17 wherein said hull includes a top wall substantially enclosing said bottom wall, said platform means comprising an intermediate portion of said top wall.

21. The watercraft combination of claim 20 wherein said top wall includes a peripheral edge portion extending around forward and side portions of said platform means and elevated above the level of said platform means.

22. The watercraft combination of claim 21 wherein said top wall includes a rearward portion sloping downwardly from a rearward end of said platform means.

23. The watercraft combination of claim 19 including a fuel tank for said outboard motor removably mounted in said housing adjacent a forward end of said platform means.

24. The watercraft combination of claim 23 including battery means removably mounted in said housing forward of said fuel tank.

25. The watercraft of claim 21 wherein said control means includes control cables for steering, shifting gears and said throttle, said peripheral edge portion of said top wall having a forward opening for said control cable in communication between said hull and said housing and a rearward opening for said control cables adjacent said transom means.

26. The watercraft of claim 19 including a safety system of shutting down said outboard motor safety switch on said housing with a removable member adapted to be interconnected to a rider and removable if said rider is unintentionally removed from said platform means.

* * * * *